US011462867B2

(12) United States Patent
Takahashi et al.

(10) Patent No.: US 11,462,867 B2
(45) Date of Patent: Oct. 4, 2022

(54) STRUCTURE FOR FIXING CONNECTOR

(71) Applicant: Yazaki Corporation, Tokyo (JP)

(72) Inventors: Kazuhide Takahashi, Makinohara (JP); Takashi Matsunaga, Makinohara (JP); Eiji Aoki, Makinohara (JP); Takahiro Kubo, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/196,392

(22) Filed: Mar. 9, 2021

(65) Prior Publication Data

US 2021/0288456 A1 Sep. 16, 2021

(30) Foreign Application Priority Data

Mar. 16, 2020 (JP) ..... JP2020-045708

(51) Int. Cl.
*H01R 13/73* (2006.01)
*H01R 13/502* (2006.01)

(52) U.S. Cl.
CPC ..... *H01R 13/73* (2013.01); *H01R 13/502* (2013.01); *H01R 2201/26* (2013.01)

(58) Field of Classification Search
CPC ... H01R 13/73; H01R 13/502; H01R 2201/26
See application file for complete search history.

(56) References Cited

U.S. PATENT DOCUMENTS 5,895,289 A 4/1999 Smith
6,217,363 B1 4/2001 Takata
8,764,481 B2 * 7/2014 Matsumoto ..... H01R 13/4223 439/595
9,318,826 B2 * 4/2016 Kato ..... B60L 50/16
9,819,169 B2 * 11/2017 Shiraki ..... H02G 3/16
11,014,433 B2 * 5/2021 Shimizu ..... B60Q 3/82
2014/0370745 A1 * 12/2014 Wu ..... H01R 13/743 439/527
2015/0044904 A1 * 2/2015 Hu ..... H01R 13/627 439/541.5
2020/0039329 A1 * 2/2020 Shimizu ..... F16B 9/056

FOREIGN PATENT DOCUMENTS

JP 62-53583 U 4/1987
JP 2-36188 U 3/1990
JP 2-54105 U 4/1990
JP 2002-271946 A 9/2002
JP 2004-319158 A 11/2004

* cited by examiner

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A structure for fixing a connector to a fixing portion includes the connector and the fixing portion. The fixing portion includes a bracket and a fitting portion. The bracket is erected on the fixing portion. The connector includes a lock portion configured to, when the bracket is inserted into the lock portion by attaching the connector to the fixing portion, lock the bracket. The fitting portion is configured such that a part of the connector is fitted into the fitting portion when the connector is attached to the fixing portion. The bracket may be integrally molded with the fixing portion molded with a resin. The fitting portion may have a hole portion running along a fitting direction in which the connector is attached to the fixing portion, and a slit may be formed in the fitting portion.

6 Claims, 6 Drawing Sheets

STRUCTURE FOR FIXING CONNECTOR

CROSS-REFERENCE TO RELATED APPLICATION

The present application claims priority to Japanese Patent Application No. 2020-045708 filed on Mar. 16, 2020, the entire content of which is incorporated herein by reference.

TECHNICAL FIELD

The present invention relates to a structure for fixing a connector.

BACKGROUND

In a related art engine control unit (ECU), a connector is fixed to an outer surface of a housing of the engine control unit (see JP2002-271946A, for example). The connector is formed with a through lock portion, and the connector can be easily fixed to the housing by being attached such that a bracket formed on the housing is inserted into the through lock portion of the connector.

However, since the bracket supporting the connector is formed in a cantilevered plate shape extending from the housing, it is difficult to support the connector with sufficient strength. In particular, when vibration that occurs during running or the like of a vehicle is applied, the bracket may be broken and the connector may fall off.

SUMMARY

Illustrative aspects of the present invention provide a structure for fixing a connector in which a connector can be easily attached to a fixing portion and the connector can be supported at the fixing portion with sufficient fixing strength.

According to an illustrative aspect of the present invention, a structure for fixing a connector to a fixing portion includes the connector and the fixing portion. The fixing portion includes a bracket and a fitting portion. The bracket is erected on the fixing portion. The connector includes a lock portion configured to, when the bracket is inserted into the lock portion by attaching the connector to the fixing portion, lock the bracket. The fitting portion is configured such that a part of the connector is fitted into the fitting portion when the connector is attached to the fixing portion.

Other aspects and advantages of the invention will be apparent from the following description, the drawings and the claims.

DESCRIPTION OF EMBODIMENTS

Figure 1A:
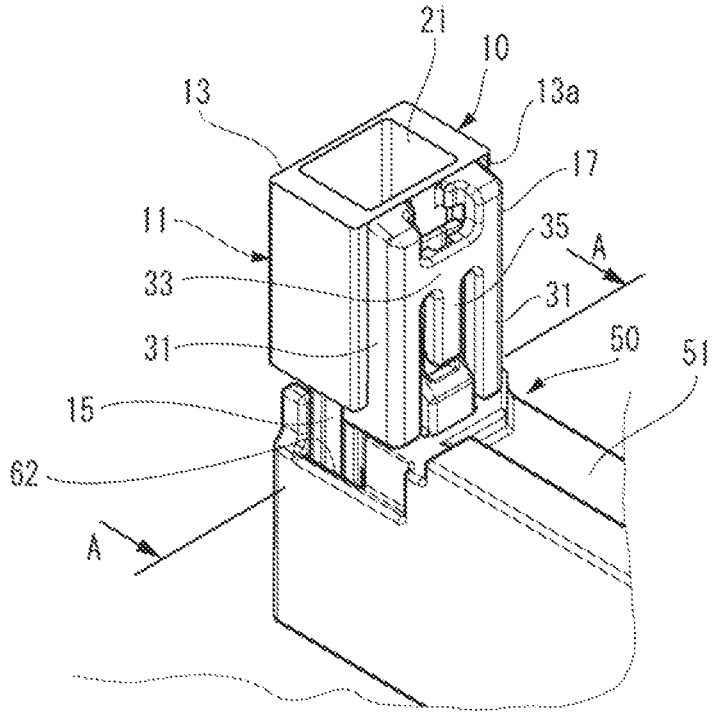
FIG. 1A is a perspective view of a structure for fixing a connector according to an embodiment that is viewed from a front side.
Figure 1B:
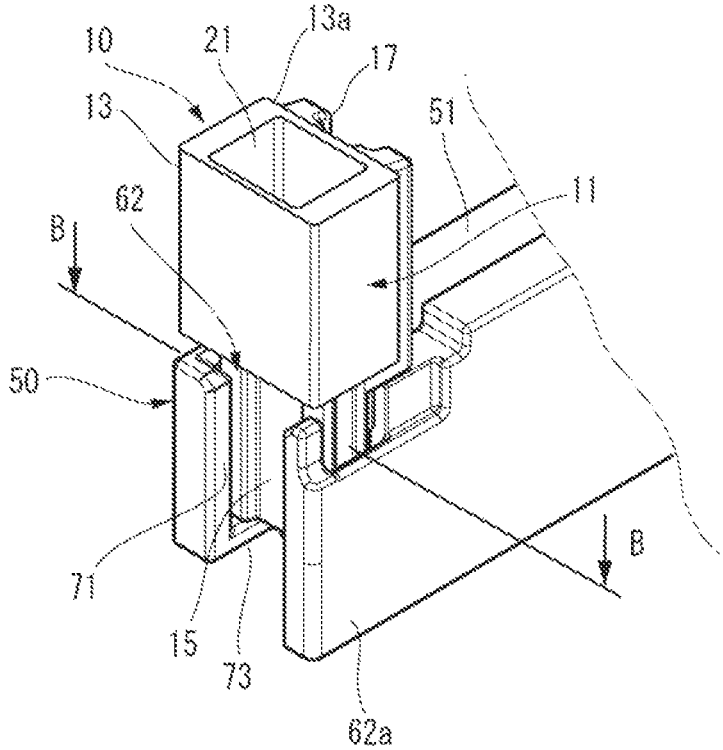
FIG. 1B is a perspective view of the structure for fixing a connector according to the embodiment that is viewed from a back side.
Figure 2:
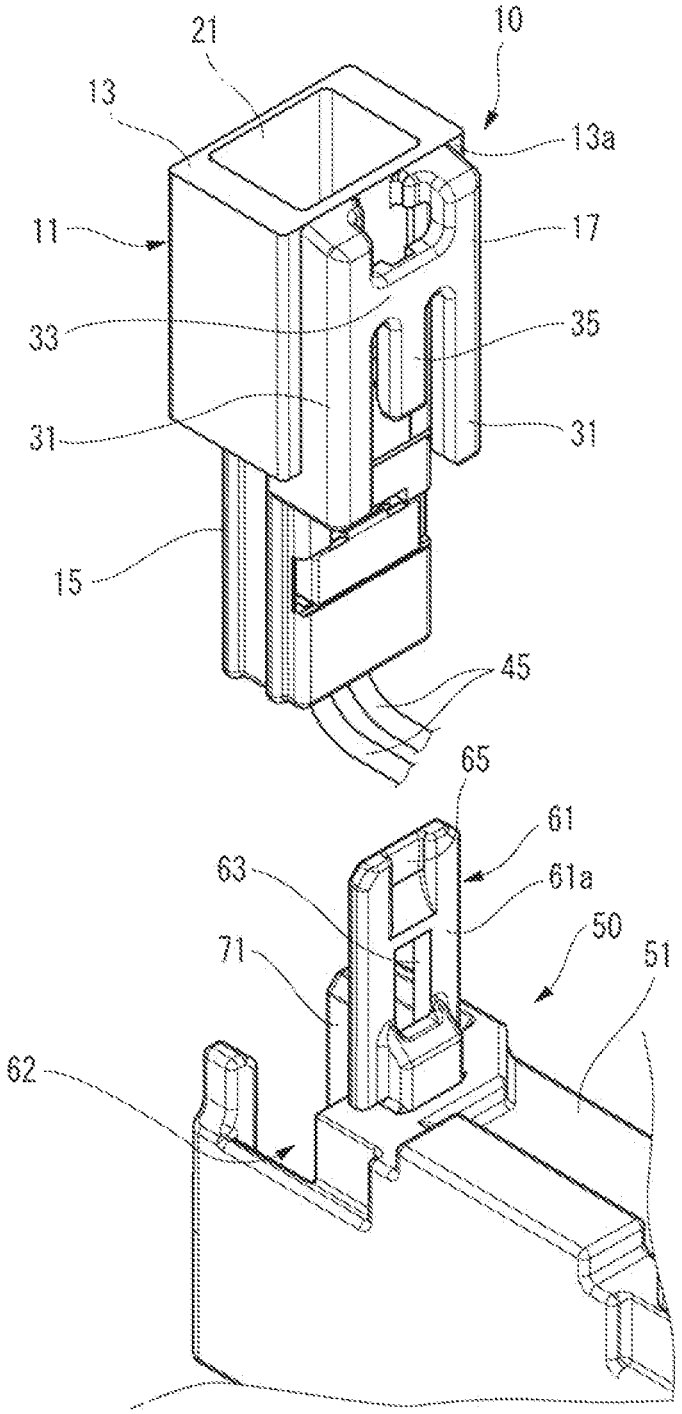
FIG. 2 is a perspective view of a fixing portion and the connector viewed from a front side before attaching the connector to the fixing portion.
Figure 3:
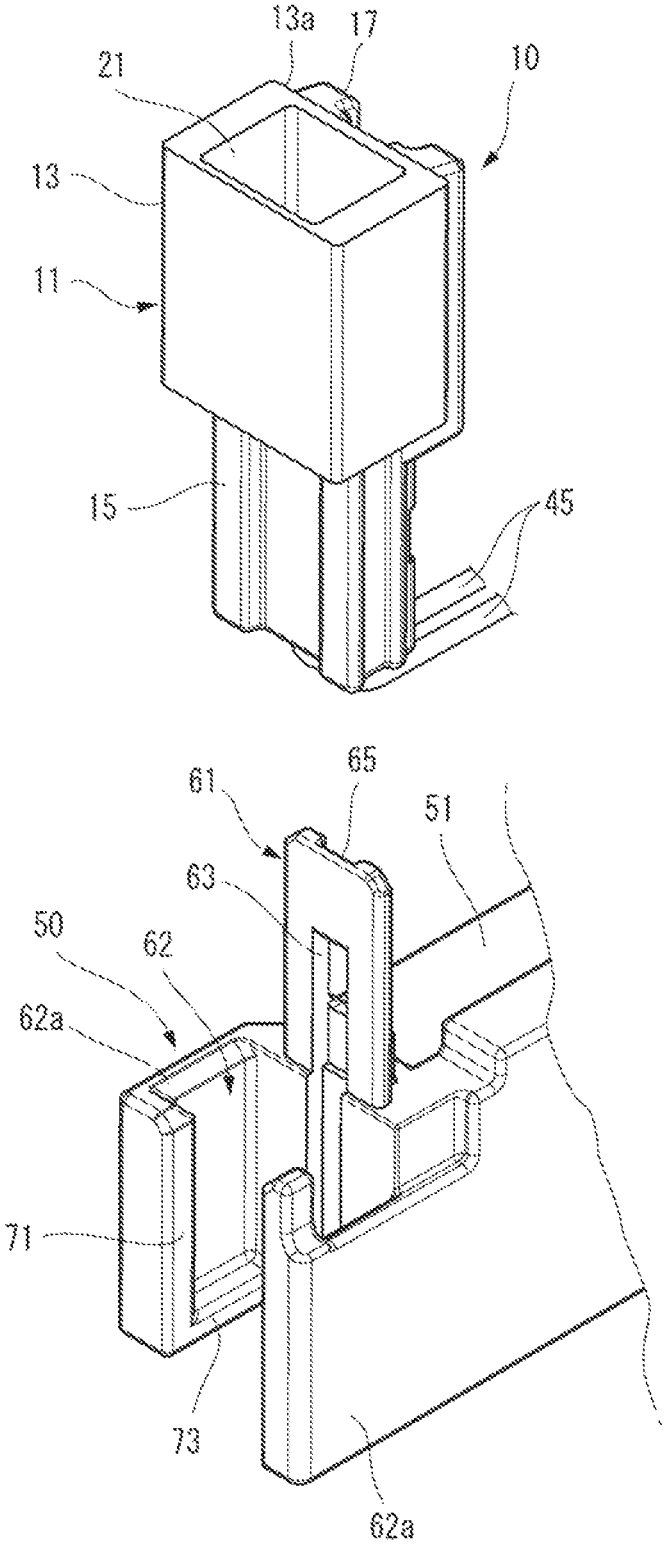
FIG. 3 is a perspective view of the fixing portion and the connector viewed from a back side before attaching the connector to the fixing portion.
Figure 4:
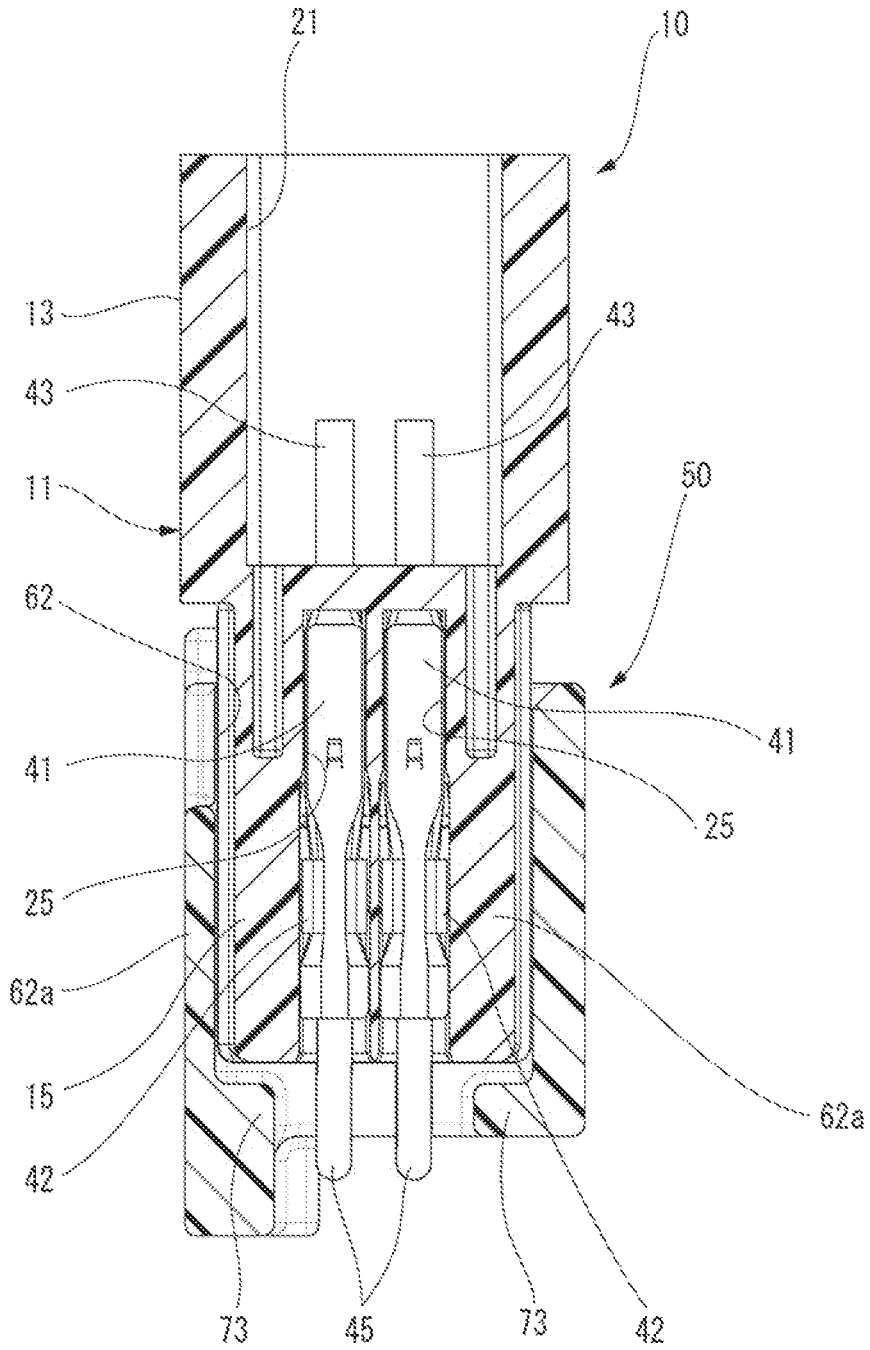
FIG. 4 is a cross-sectional view taken along a line A-A in FIG. 1A.
Figure 5:
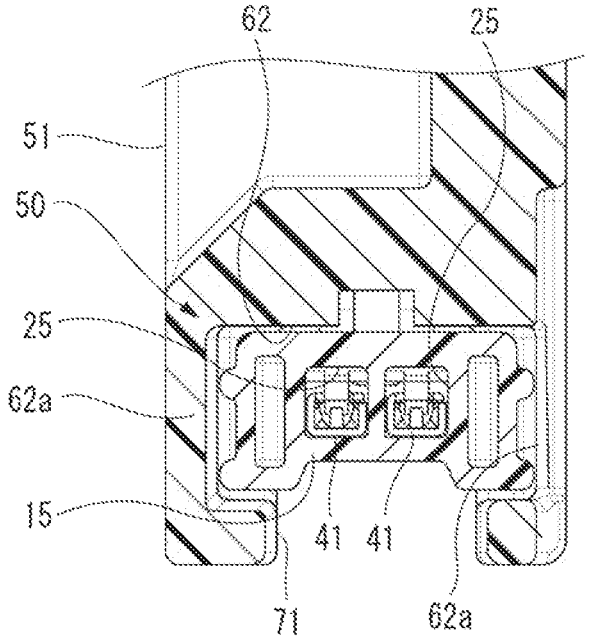
FIG. 5 is a cross-sectional view taken along a line B-B in FIG. 1B.

Hereinafter, an example of an embodiment according to the present invention will be described with reference to the drawings. FIG. 1A is a perspective view of a structure for fixing a connector according to the present embodiment that is viewed from a front side. FIG. 1B is a perspective view of the structure for fixing a connector according to the present embodiment that is viewed from a back side. FIG. 2 is a perspective view of a fixing portion and the connector viewed from a front side before attaching the connector to the fixing portion. FIG. 3 is a perspective view of the fixing portion and the connector viewed from a back side before attaching the connector to the fixing portion. FIG. 4 is a cross-sectional view taken along a line A-A in FIG. 1A. FIG. 5 is a cross-sectional view taken along a line B-B in FIG. 1B.

As illustrated in FIGS. 1A to 5, the structure for fixing a connector according to the present embodiment is a structure for fixing a connector 10 with respect to a fixing portion 50.

In this example, the fixing portion 50 is provided in a terminal block 51 of an inverter, a high-voltage unit or the like. However, the fixing portion 50 may be provided in a housing or the like of various devices such as an electrical connection box and an engine control unit (ECU), not limited to the terminal block 51.

The connector 10 has a housing 11 molded with an insulating synthetic resin. The housing 11 is formed to have a rectangular shape in a cross-sectional view. The housing 11 includes a hood portion 13, a terminal accommodating portion 15, and a lock portion 17. The terminal accommodating portion 15 is formed to have an outer shape smaller than that of the hood portion 13 in a cross-sectional view. The lock portion 17 is formed on one side surface 13*a* of the hood portion 13 of the housing 11.

The hood portion 13 is formed in a rectangular tube shape having a fitting recess 21. A housing (not shown) of a mating connector is to be fitted into the fitting recess 21 of the hood portion 13.

A pair of terminal accommodating chambers 25 is formed in the terminal accommodating portion 15, and male terminals 41 are to be inserted from end portions opposite from the hood portion 13 and are accommodated in the terminal accommodating chambers 25. The male terminal 41 is to be connected to a female terminal (not shown) of a mating connector which is to be fitted into the fitting recess 21 of the hood portion 13.

The lock portion 17 includes a pair of wall portions 31, a beam portion 33 extending between the wall portions 31, and a locking piece 35 formed on the beam portion 33. The beam portion 33 bridges between/connects the pair of wall portions 31. The locking piece 35 extends toward the terminal accommodating portion 15 along one side surface 13*a* of the hood portion 13. The locking piece 35 extends from a middle portion of the beam portion 33. A locking claw (not shown) protruding toward the one side surface 13*a* of the hood portion 13 is formed at a tip end of the locking piece 35.

The male terminal 41 accommodated in the terminal accommodating chamber 25 of the terminal accommodating portion 15 is formed of, for example, a conductive metal material such as copper or a copper alloy. The male terminal 41 includes an electric wire connection portion 42 and a connecting pin portion 43. An electric wire 45 is connected to the electric wire connection portion 42 by, for example, crimping connection or the like. The electric wire 45 connected to the male terminal 41 is drawn out from an end portion of the housing 11 on a side at which the terminal accommodating portion 15 is provided. The connecting pin portion 43 is to be disposed in the fitting recess 21 of the hood portion 13 and is to be inserted into the female terminal of the mating connector. Accordingly, the male terminal 41 is electrically connected to the female terminal.

The terminal block 51 is molded with an insulating synthetic resin. The fixing portion 50 provided in the terminal block 51 includes a bracket 61 and a fitting portion 62. The bracket 61 is molded integrally with the terminal block 51. The bracket 61 is formed in a plate shape and is erected on the fixing portion 50. The bracket 61 has a width dimension slightly smaller than an interval between the wall portions 31 of the lock portion 17 of the connector 10. A locking hole 63 is formed in the bracket 61. The locking hole 63 runs through the bracket 61 in a thickness direction of the bracket 61. An introducing groove portion 65 is formed on a side surface 61*a* of the bracket 61. The introducing groove portion 65 extends from an upper end of the bracket 61 up to the vicinity of/near/close to the locking hole 63, and gradually becomes shallower toward a side at which the locking hole 63 is provided. It may also be described that the introducing groove portion 65 extends such that the introducing groove portion 65 does not communicate with the lock hole 63.

Figure 6:
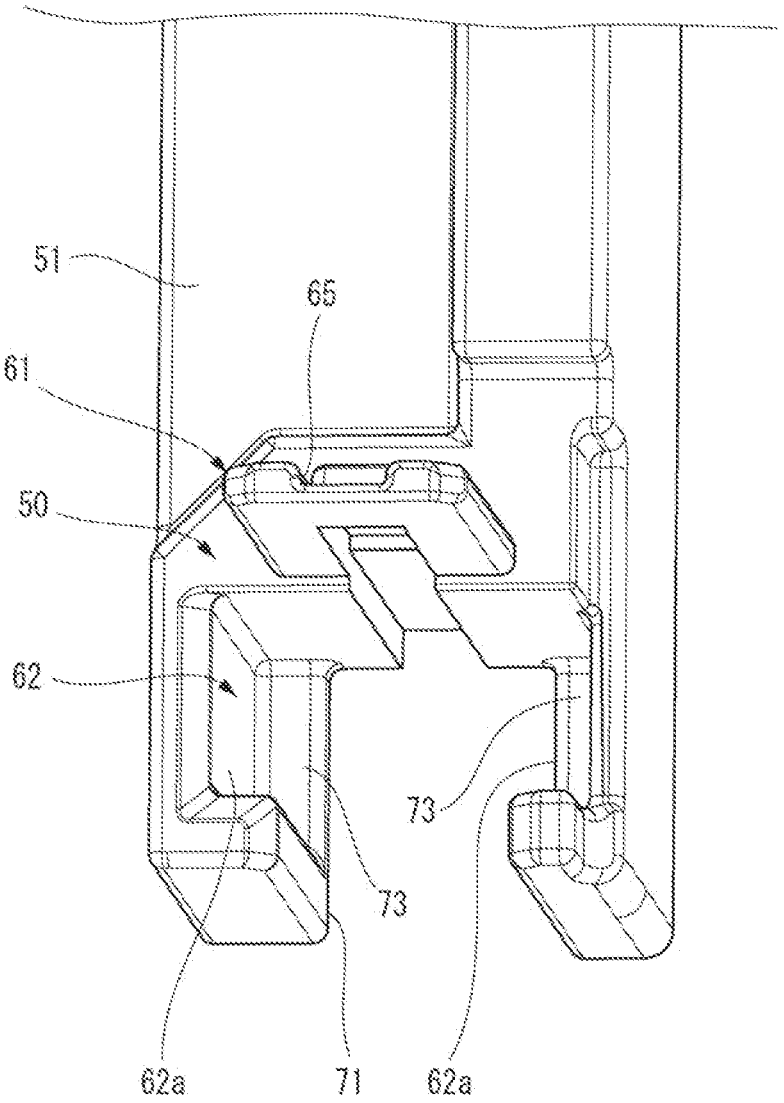
FIG. 6 is a perspective view of the fixing portion viewed from above.

FIG. 6 is a perspective view of the fixing portion viewed from above. As shown in FIG. 6, the fitting portion 62 is formed at a position adjacent to/next to the bracket 61. In other words, the bracket 61 protrude from an upper edge of the fitting portion 62, the upper edge defining an opening of the fitting portion 62. The fitting portion 62 is formed as a hole portion that penetrates the terminal block 51 in a fitting direction in which the connector 10 is fitted to the fixing portion 50. In other words, the fitting portion 62 has a hole portion. The terminal accommodating portion 15 of the housing 11 of the connector 10 is configured to be fitted into the fitting portion 62. The fitting portion 62 has an inner shape slightly larger than an outer shape of the terminal accommodating portion 15. In the fitting portion 62, a slit 71 is formed on a side opposite to another side at which the bracket 61 is provided, along the fitting direction of the connector 10 to the fixing portion 50. The slit communicates with the hole portion. A bottom wall portion 73 is formed in the fitting portion 62 on a front side in the fitting direction of the connector 10 to the fixing portion 50. The bottom wall portion 73 is formed at an end portion of each of both side wall portions 62*a* forming the fitting portion 62.

In order to attach the connector 10 to the fixing portion 50 of the terminal block 51, the connector 10 is brought close to the fixing portion 50 from above, and the bracket 61 is positioned between the wall portions 31 of the lock portion 17 of the connector 10. At this time, the electric wire 45 drawn out from the end portion of the terminal accommodating portion 15 of the connector 10 can be disposed in the fitting portion 62 through the slit 71.

In this state, the connector 10 is pushed toward the fixing portion 50. Then, the bracket 61 is inserted into a gap between the beam portion 33 of the lock portion 17 and the one side surface 13*a* of the hood portion 13. Accordingly, the locking piece 35 of the lock portion 17 enters the introducing groove portion 65 and is guided to the introducing groove portion 65. Further, the locking claw of the locking piece 35 enters the locking hole 63 of the bracket 61, and the lock portion 17 is locked to the bracket 61.

When the lock portion 17 is locked to the bracket 61 after bringing the connector 10 toward the fixing portion 50 from above, the terminal accommodating portion 15 of the housing 11 is fitted into the fitting portion 62. As described above, since the terminal accommodating portion 15 of the housing 11 is fitted and held in the fitting portion 62, the connector 10 is firmly held by the fixing portion 50 by a holding force of the fitting portion 62 together with a supporting force of the bracket 61.

As described above, according to the structure for fixing a connector according to the present embodiment, when the bracket 61 erected on the fixing portion 50 is inserted into the lock portion 17, the lock portion 17 locks the bracket 61. Accordingly, the connector 10 can be attached to the fixing portion 50 while being supported by the bracket 61. At this time, since the terminal accommodating portion 15, which is a part of the connector 10, is fitted to the fitting portion 62 of the fixing portion 50, it is possible to increase the fixing strength of the connector 10 that is attached to the fixing portion 50 while being supported by the bracket 61. This makes it possible to maintain a good fixed state of the connector 10 to the fixing portion 50 without breaking the bracket 61 even when vibration occurring during running or the like of the vehicle is applied. In addition, even when strength of the bracket 61 is lowered in order to reduce the cost, the connector 10 can be attached to the fixing portion 50 with sufficient fixing strength.

In this way, a part of the connector 10 is fitted to the fitting portion 62 to increase the fixing strength of the connector 10 being fixed to the fixing portion 50, and a force applied to the bracket 61 is reduced. Therefore, even if the bracket 61 is integrally molded with the fixing portion 50 made of resin, the connector 10 can be sufficiently supported while preventing breakage or damage of the bracket 61. In addition, the number of components can be reduced, the manufacturing cost can be reduced, and the size can be reduced as compared with a case where the bracket 61 made of metal and being a separate component is fixed to the fixing portion 50 or is insert-molded.

In addition, the fitting portion 62 of the fixing portion 50 has the slit 71 formed in a side portion of the fitting portion 62 along the fitting direction of the connector 10 to the fixing portion 50. Therefore, the electric wire 45 can be inserted into the fitting portion 62 from a side through the slit 71. Therefore, it is not necessary to perform complicated preparation in which the electric wire 45 has to be first passed through the fitting portion 62, and it is possible to improve workability of a fixing operation of fixing the connector 10 to the fixing portion 50.

In the above embodiment, the bracket 61 is integrally molded with the fixing portion 50 made of resin. However, the bracket 61 may be made of a metal material, alternatively. In this case, the bracket 61 is provided by insert molding in the fixing portion 50 or is press-fitted and fixed to a hole formed in the fixing portion 50.

The fitting portion 62 may be a bottomed recess into which the terminal accommodating portion 15 of the housing 11 can be fitted, and is not limited to a hole portion.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

According to an aspect of the embodiments described above, a structure for fixing a connector (10) to a fixing portion (50) includes the connector (10) and the fixing portion (50). The fixing portion (50) includes a bracket (61) and a fitting portion (62). The bracket (61) is erected on the fixing portion (50). The connector (10) includes a lock portion (17) configured to, when the bracket (61) is inserted into the lock portion (17) by attaching the connector (10) to the fixing portion (50), lock the bracket (61). The fitting portion (62) is configured such that a part of the connector (10) is fitted into the fitting portion (62) when the connector (10) is attached to the fixing portion (50).

According to the structure for fixing a connector having the above described configuration, when the bracket erected on the fixing portion is inserted into the lock portion of the connector, the lock portion locks the bracket. Accordingly, the connector can be attached to the fixing portion while being supported by the bracket. At this time, since a part of the connector is fitted to the fitting portion of the fixing portion, fixing strength of the connector supported by the bracket and attached to the fixing portion can be increased. Accordingly, even when vibration occurring during running or the like of a vehicle is applied, it is possible to maintain a good fixed state of the connector to the fixing portion without the bracket getting broken. In addition, even when strength of the bracket is lowered in order to reduce the cost, the connector can be attached to the fixing portion with sufficient fixing strength.

The bracket (61) may be integrally molded with the fixing portion (50) molded with a resin.

With this configuration, since a part of the connector is fitted to the fitting portion, the fixing strength to the fixing portion is increased and a force applied to the bracket is reduced Therefore, even when the bracket is integrally molded with the fixing portion made of a resin, it is possible to sufficiently support the connector while preventing breakage or damage of the bracket. In addition, the number of components can be reduced, the manufacturing cost can be reduced, and the size can be reduced as compared with a case where the bracket made of metal and being a separate component is fixed to the fixing portion or is insert-molded.

The fitting portion (62) may have a hole portion running along a fitting direction in which the connector (10) is attached to the fixing portion (50). A slit (71) may be formed in the fitting portion (62). The slit (71) may run along the fitting direction and communicate with the hole portion.

With this configuration, it is possible to insert an electric wire from a side through the slit with respect to the fitting portion formed of the hole portion. Therefore, it is not necessary to perform complicated preparation in which the electric wire has to be first passed through the fitting portion formed of a hole portion, and it is possible to improve workability of a fixing operation of fixing the connector to the fixing portion.

What is claimed is:

1. A structure for fixing a connector to a fixing portion comprising:

the connector; and the fixing portion, wherein the fixing portion comprises a bracket and a fitting portion, the bracket being erected on the fixing portion, wherein the connector comprises a lock portion configured to, when the bracket is inserted into the lock portion by attaching the connector to the fixing portion, lock the bracket, and wherein the fitting portion is configured such that a part of the connector is fitted into the fitting portion when the connector is attached to the fixing portion.

2. The structure according to claim 1, wherein the bracket is integrally molded with the fixing portion molded with a resin.

3. The structure according to claim 1, wherein the fitting portion has a hole portion running along a fitting direction in which the connector is attached to the fixing portion, and a slit is formed in the fitting portion, the slit running along the fitting direction and communicating with the hole portion.

4. The structure according to claim 1, the bracket is erected above the fitting portion.

5. The structure according to claim 1, wherein the part of the connector is fitted within a hole of the fitting portion when the connector is attached to the fixing portion.

6. The structure according to claim 5, wherein the bracket is erected above the fitting portion.

* * * * *